United States Patent [19]

Daughtry

[11] 4,326,349

[45] Apr. 27, 1982

[54] GREETING CARD DISPLAY DEVICE

[76] Inventor: Georgia A. Daughtry, 1107 Cedar St., Elizabeth City, N.C. 27909

[21] Appl. No.: 106,103

[22] Filed: Dec. 21, 1979

[51] Int. Cl.[3] ..... A47G 1/06; G09F 1/00; G09F 3/18; G09F 7/02

[52] U.S. Cl. ..... 40/152.1; 40/124.1; 40/10 D; 40/16; 40/611

[58] Field of Search ..... 40/152.1, 10 B, 10 D, 40/124, 124.1, 124.2, 16, 605, 606, 611, 155, 159, 537, 405; 229/71; 150/39

[56] References Cited

U.S. PATENT DOCUMENTS

| | | | |
|---|---|---|---|
| 841,943 | 1/1907 | Dodsworth | 150/39 |
| 942,669 | 12/1909 | Sauerwein et al. | 40/159 X |
| 1,073,768 | 9/1913 | Loveland | 40/16 |
| 2,634,777 | 4/1953 | Berger | 40/15 |
| 3,446,260 | 5/1969 | Osher | 40/159 |
| 4,102,067 | 7/1978 | Tarrant | 40/152.1 X |
| 4,125,243 | 11/1978 | Liptak | 40/152.1 X |

FOREIGN PATENT DOCUMENTS

| | | | |
|---|---|---|---|
| 1170565 | 1/1959 | France | 40/159 |
| 1429428 | 1/1966 | France | 150/39 |
| 1447796 | 6/1966 | France | 150/39 |

*Primary Examiner*—Gene Mancene
*Assistant Examiner*—Michael J. Foycik
*Attorney, Agent, or Firm*—Marvin S. Towsend

[57] ABSTRACT

An article for displaying a plural leafed greeting card. The plural leaves may move around a common axis, or they may move around different axes. An article for displaying a two-leafed greeting card is made of two leaf supports connected together at a desired display angle, either stationary or variable, by a hinge. The first leaf support has a first part for receiving the first laf of the greeting card and is transparent on both faces to allow display of both sides of the first leaf of the greeting card. The second leaf support has a second part for receiving the last leaf of the greeting card and has at least one transparent side allowing display of at least one side of the second leaf of the greeting card. The display article may be inserted in a separate frame and support having added esthetic properties or having additional features such as added strength to protect against breakage during shipment, such as through the mail. An article for displaying a three-leafed greeting card, where the first and third leaves move around different axes, is made of three leaf supports having a first connecting part, such as a hinge, between the first and second leaf supports and having a second connecting part between the second and third leaf supports. The first leaf support and first part for receiving the first leaf of the greeting card are transparent on both sides to allow unhindered viewing of both sides of the first leaf of the greeting card.

3 Claims, 6 Drawing Figures

GREETING CARD DISPLAY DEVICE

BACKGROUND OF THE INVENTION

The invention relates to display devices for greeting cards. A greeting card generally is comprised of at least two leaves connected at one or more creases. The first leaf usually has pictorial or printed matter on both the outer and inner sides. The last leaf usually has the pictorial or printed matter only on the inner side. Greeting cards have always been treasured and saved by recipients of them. They have not however had a satisfactory display method or device suitable for use by a recipient in the home. Prior art devices such as U.S. Pat. Nos. 3,791,651; 3,797,149; and 4,007,551 disclose devices for displaying greeting cards wherein there is no provision for displaying both the outside and inside sides of the first leaf and the inside of the last leaf of a greeting card simultaneously. Furthermore, the prior art does not disclose a greeting card display device covering and protecting the greeting card from dust and handling by persons reading the card.

It is an object of the invention, therefore, to provide a greeting card display device enabling display of both sides of the first leaf and at least one side of the last leaf of a conventional greeting card simultaneously.

Another object of the invention is to provide a greeting card display device having means for variable adjustment of the display angle of the leaves of the greeting cards.

An additional object of the invention is to provide a greeting card display device suitable for insertion in an additional frame support having additional aesthetic display attributes or other features specifically designed for shipping or mailing.

Another object of the invention is to provide a greeting card display device which displays the greeting card and, at the same time, protects it from dust and human handling.

Another object of the invention is to provide a greeting card display device suitable for operation in conjunction with a conventional photograph display frame.

Another object of the invention is to provide a greeting card display frame suitable for displaying a greeting card having a plurality of pages moving around a common axis.

Another object of the invention is to provide a greeting card display frame suitable for displaying a greeting card having a plurality of pages moving around different axes.

SUMMARY OF THE INVENTION

The invention is a greeting card display device, comprising: a first leaf support having a first means for receiving the first leaf of the greeting card and allowing viewing of both the outer and inner sides of the first leaf of the greeting card; means for connecting the first leaf support to a second leaf support; a second leaf support having a second means for receiving the second leaf of the greeting card and allowing viewing of at least the inner side of the second leaf of the greeting card. The means for connecting the first and second leaf supports may be stationary or variable such as a hinge. The greeting card display device may be self supporting or may be inserted into an additional support device such as a conventional photograph display frame or a frame having added strength making it suitable for sending through the mail. Greeting cards having more than two leaves moving around a common axis may be accommodated by the invention by using additional leaf supports similar to the first support which allows viewing of both sides of each additional leaf. Greeting cards having a plurality of leaves moving around different axes may be accommodated by the invention by using additional leaf supports which also move around the different axes. Support feet may be provided allowing any desired viewing display angle without the display's falling over.

DETAILED DESCRIPTION OF THE INVENTION

Figure 1:
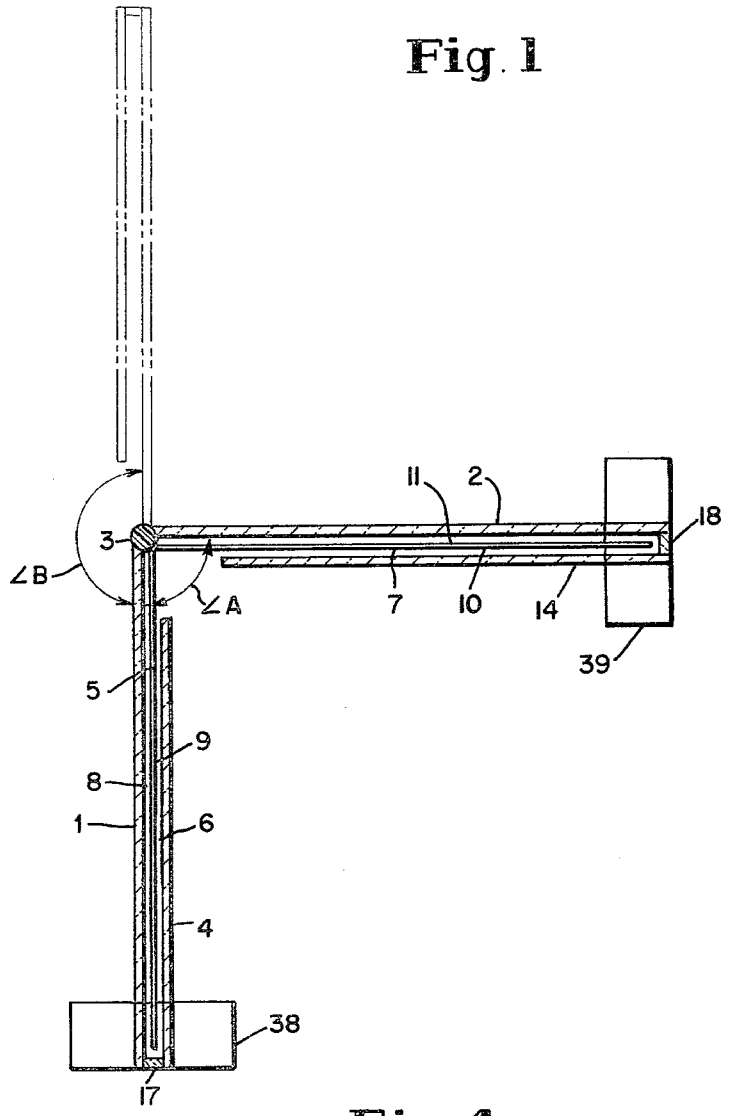
FIG. 1 shows a top cross section view of an embodiment of the invention along cutting plane 1—1 in FIG. 3.

In FIG. 1, a first leaf support 1 is connected by connecting means 3 to second leaf support 2. A two-leafed greeting card 5 is shown in place. First leaf 6 of greeting card 5 is supported by first leaf support 1 and retained by first receiving means 4 for receipt of the first greeting card leaf 6. Second leaf support 2 is provided with second receiving means 14 for receipt of the second leaf 7 of greeting card 5. First leaf support 1 and the first receiving means 4 for receipt of the first greeting card leaf may be merely a frame structure provided with a slot for frictional engagement with the first leaf 6 of the greeting card along at least one edge of the leaf. Such a leaf support and retaining means for first greeting card leaf 6 in this case would be a perimeter support and retainer, allowing unhindered viewing of both the outer side 8 and the inner side 9 of the first leaf 6 of the greeting card 5. A similar type of frame for second leaf support 2 and second receiving means 14 for receipt of the second greeting card leaf 7 would allow an unhindered view of the inner side 10 of second leaf 7 of the greeting card 5. The first leaf support may include one or two transparent surfaces to fully cover either the outer side 8 or the inner side 9 or both sides 8 and 9 of the first leaf 6 of the greeting card 5. This would still allow unhindered viewing of both sides 8 and 9 of the first leaf 6 of the greeting card 5 and would provide an additional feature of keeping out dust and protecting the greeting card from human handling. Similarly, the second leaf support 2 may be provided with one or more transparent members to provide protection against dust and handling. For second leaf support 2, only the inward facing side 10 of second leaf 7 of the greeting card 5 need be provided with a transparent cover to provide unhindered viewing. Generally, the outer side 11 of second leaf 7 of greeting card 5 does not contain either pictorial or printed matter which is desired for display.

Figure 4:
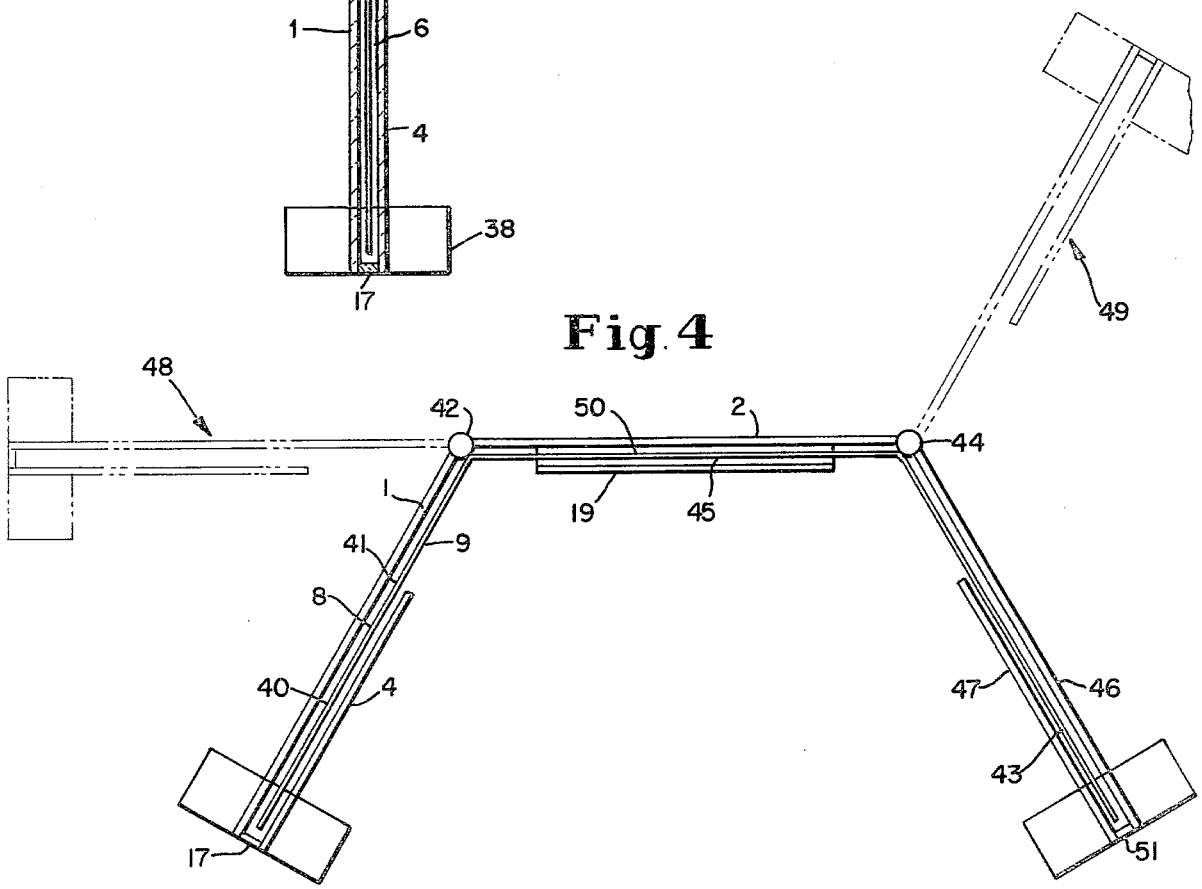
FIG. 4 shows a top cross section view of an embodiment of the invention for a greeting card having a plurality of pages moving around different axes.

In FIG. 1, a satisfactory display angle A is shown between leaves 6 and 7 of the greeting card. Angle B is shown which indicates that first leaf support 1 and second leaf support 2 may be adjusted to angle B prior to receipt of greeting card 5. This angle would allow the greeting card 5 to be sent back at the same angle B for easy insertion into the means 4 and 19 for receiving the greeting card leaves on both first leaf support 1 and second leaf support 2. Subsequent to insertion in the display device, the angle may be adjusted to any desired display angle. Support feet 38 and 39 are provided to allow any desired viewing display angle without the display's falling over. First leaf support 1 and greeting card leaf receipt means 4 are shown in dotted outline at angle B. It is noted that, by removing spacer 18 and adding hinge 44 and third leaf support 46, as shown in FIG. 4, the two-leafed display can be used to display a three-leafed card.

Figure 2:
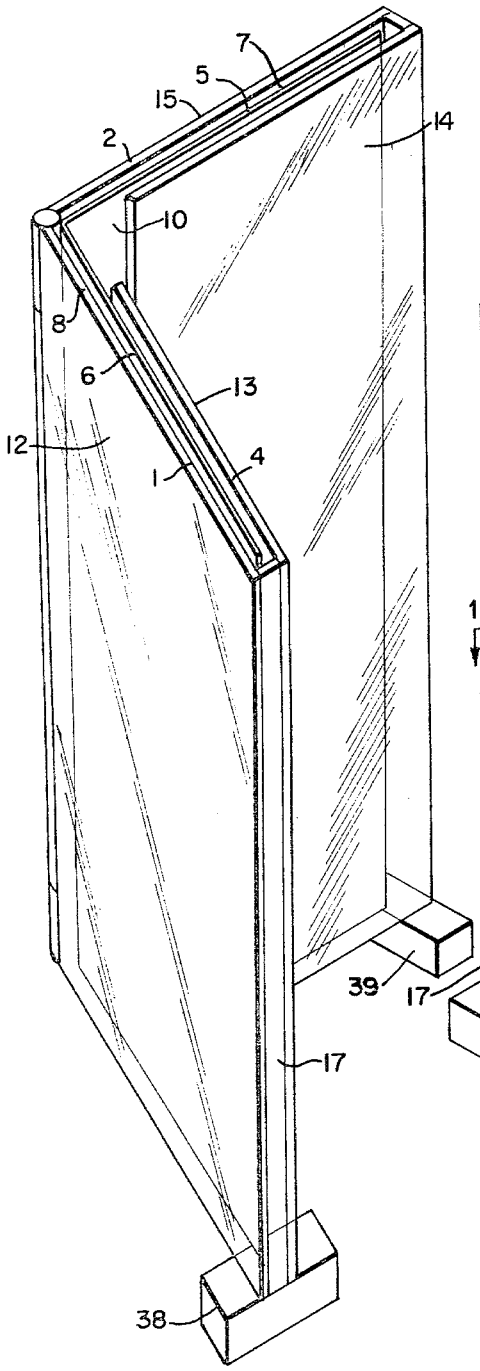
FIG. 2 shows a perspective view of an embodiment of the invention exhibiting the outer side of the first leaf of the greeting card and the inner side of the second leaf of a two-leafed card.

FIG. 2 shows a perspective view of an embodiment of the greeting card display device from a viewpoint wherein the outward side 8 of first leaf 6 of greeting card 5 is visible simultaneously with the inner side 10 of second leaf 7 of greeting card 5.

Figure 3:
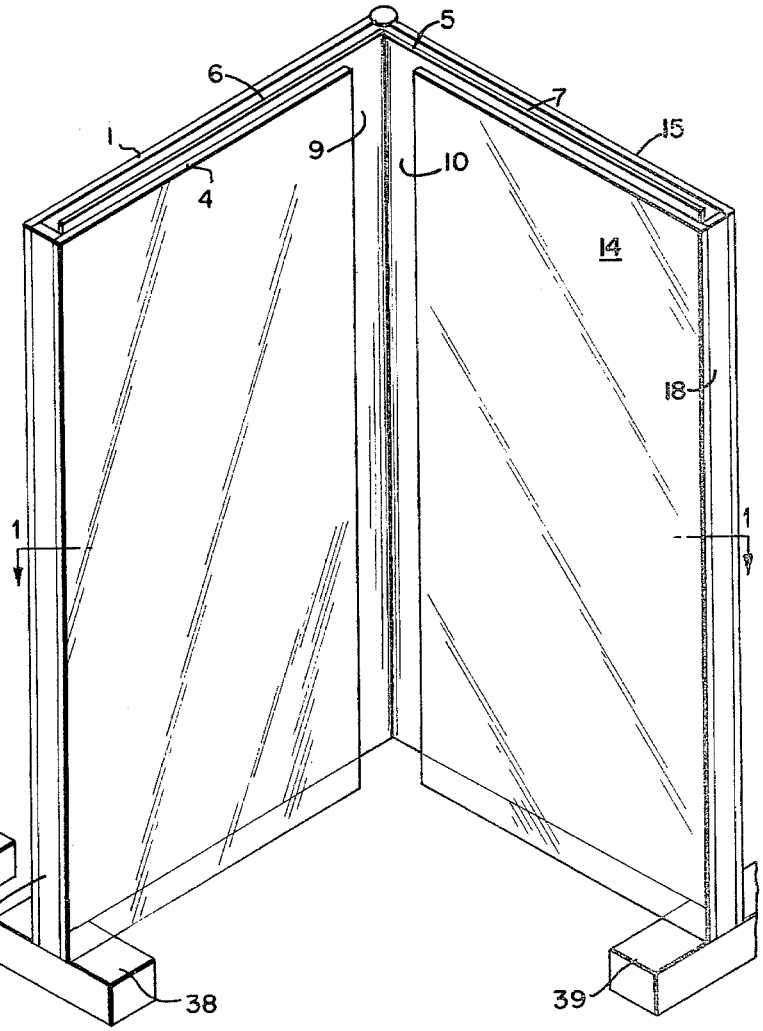
FIG. 3 shows a perspective view of an embodiment of the invention exhibiting the inner sides of both the first and second leaves of a two-leafed greeting card.

FIG. 3 shows a view of a greeting card display device of the invention wherein inner side 9 of first leaf 6 of greeting card 5 is visible simultaneously with inner side 10 of second leaf 7 of greeting card 5.

In FIGS. 2 and 3, first leaf support 1 has transparent surface 12. First receiving means 4 for receipt of the first greeting card leaf 6 has transparent surface 13. A space is provided between transparent surfaces 12 and 13 by spacer 17 in FIG. 2. Second leaf support 2 has surface 15 which may be either transparent or opaque. Second receiving means 14 for receipt of the second greeting card leaf 7 has transparent surface 14. A space is provided between surfaces 14 and 15 by spacer 18 in FIG. 3.

In FIG. 4, an embodiment of the invention as shown for displaying a greeting card having a plurality of leaves moving around different axes. First leaf 40 of greeting card 41 moves around an axis adjacent to hinge 42 serving as a first means 42 for connecting the first and second leaf support. Third leaf 43 moves around a different axis, namely an axis adjacent to hinge 44 which serves as a second means 44 for connecting the second and third leaf supports.

First leaf support 1 and first means for receiving the first greeting card leaf 40 are similar to the same elements described above with regard to FIGS. 1, 2 and 3. Second leaf support 2 and second means for receiving the second greeting card leaf 45 are also similar to the same elements described above in regard to FIGS. 1, 2 and 3 with the following exceptions. Spacer 18 is removed allowing the second leaf 45 of card 41 to extend up to hinge 44. Third leaf support 46 and third means 47 for receiving third leaf 43 of greeting card 41 is attached by hinge 44 to second leaf support 2. Spacer 51 is placed between third leaf support 46 and means 47 for receiving third leaf 43 of the greeting card 41.

Such a three-leafed card may be inserted into the display shown in FIG. 4 as follows. Leaf support 1 and leaf support 2 are lined up along line 48. Third leaf support 46 is moved back to line 49. First leaf 40 of card 41 is inserted firstly into the space 50 between second leaf support 2 and second means 19 for receipt of second greeting card leaf 45. After passing through this space, first leaf 40 enters the space between first leaf support 1 and first means 4 for receipt of first leaf 40. At the same time this occurs, second leaf 45 enters the space 50. Also, third leaf 43 of card 41 enters into the space between third leaf support 46 and third means 47 for receipt of third leaf 43 of greeting card 41. After each leaf of the greeting card is in its corresponding display region, the leaf supports may be readjusted at a desired display angle.

The embodiment of the invention shown in FIG. 4 may be used in another way. It may be used for displaying a two-leafed greeting card in the first two leaf supports simultaneously with a photograph or other single leafed item in the third leaf support.

Figure 5:
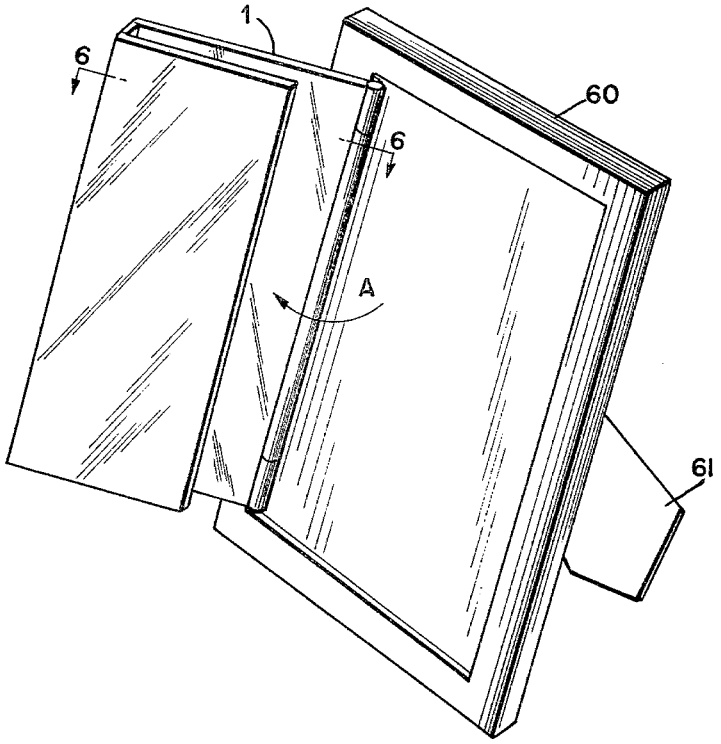
FIG. 5 shows a perspective view of an embodiment of the invention wherein a display frame is used in conjunction with a leaf support for the first leaf of the greeting card.
Figure 6:
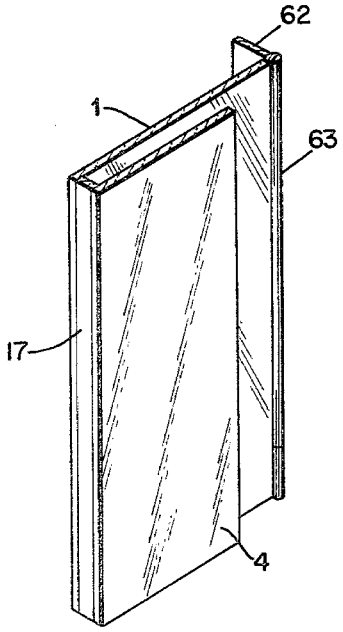
FIG. 6 shows top cross section of the first leaf support shown in FIG. 5 having a flange for insertion into the display frame.

It is contemplated that an embodiment of the invention may be used in conjunction with an additional support such as shown in FIG. 5. A frame-like structure 60 similar to a conventional picture frame in appearance, and having its own means 61 for supporting the frame and retaining the frame and contents in an off-vertical position, may be employed to serve as second leaf support and second means for receiving second greeting card leaf. As shown in FIG. 6, a top cross section view taken along cutting plane 6—6 in FIG. 5 disregarding the structure of the support frame, first leaf support 1 has a flange 62 which is inserted into frame 60 in FIG. 5. As viewing angle A is changed, hinge 63 accomodates the altered viewing angle. First leaf support 1 is connected to first means 4 for receiving the first leaf of the greeting card by spacer 17. Flange 62 on first leaf support 1 serves as connecting means between first leaf support 1 and second leaf support 60. Added aesthetic properties may be obtained by the frame. This combination may provide an additional benefit in that it may be designed to provide for mailing or shipping the combination.

The materials of which the first, second and third leaf supports and means for receiving the greeting card leafs are comprised may vary. Transparent plastic such as Plexiglass or Lucite may be employed. A combination of a metal perimeter and a transparent plastic or glass plate may also be employed.

For purposes of description of the invention, a distinction has been made between the leaf supports and the means for receiving the greeting card leaves. This distinction may be disregarded upon manufacturing an embodiment of the invention. A unitary, shell-like structure may be obtained incorporating all the features of the distinct leaf supports and means for receiving the greeting card leaves as described above.

The transparent covers may be removable from the leaf supports for insertion of the greeting card and then replaceable after the greeting card has been placed on the leaf supports.

What is claimed is:

1. An article for displaying greeting cards having at least two leaves, comprising:

a. a first leaf support and first means for receiving one greeting card leaf;

b. a second leaf support and a second means for receiving a second greeting card leaf, said second leaf support having a frame means; and c. separable connecting means connected to said first leaf support for connecting with said frame means of said second leaf support.

2. An article for displaying greeting cards having at least two leaves as described in claim 1 wherein said connecting means is a flange means which is insertable into said frame means.

3. An article for displaying greeting cards having at least two leaves as described in claim 2, further comprising a hinge means wherein said hinge means interconnects said flange means and said first leaf support.

* * * * *